US008187031B2

(12) United States Patent
Li et al.

(10) Patent No.: US 8,187,031 B2
(45) Date of Patent: May 29, 2012

(54) ELECTRICAL CONNECTOR WITH AN IMPROVED BOARD LOCK

(75) Inventors: Zhuang-Xing Li, Kunshan (CN); Xiao-Zhi Fu, Kunshan (CN); Ting-Shun Liu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/912,783

(22) Filed: Oct. 27, 2010

(65) Prior Publication Data

US 2011/0104926 A1 May 5, 2011

(30) Foreign Application Priority Data

Oct. 27, 2009 (CN) ..... 2009 2 0313325

(51) Int. Cl.
*H01R 13/60* (2006.01)

(52) U.S. Cl. ..... 439/567

(58) Field of Classification Search ..... 439/157, 439/567, 571, 328, 570.153, 372
See application file for complete search history.

(56) References Cited

U.S. PATENT DOCUMENTS 5,827,089 A * 10/1998 Beck, Jr. ..... 439/567
6,132,228 A * 10/2000 Lang ..... 439/160
6,152,749 A * 11/2000 Tseng et al. ..... 439/160
6,200,149 B1 * 3/2001 Chi-Chung ..... 439/160
6,824,407 B1 * 11/2004 Zhao et al. ..... 439/157
7,121,862 B2 10/2006 Tang et al.
7,789,681 B2 * 9/2010 Guan et al. ..... 439/157
7,892,006 B2 * 2/2011 Guan et al. ..... 439/328
2005/0153585 A1 * 7/2005 Bu et al. ..... 439/79
2010/0167558 A1 * 7/2010 Guan et al. ..... 439/65
2011/0034055 A1 * 2/2011 Yao et al. ..... 439/329

FOREIGN PATENT DOCUMENTS

TW M248108 10/2004

* cited by examiner

*Primary Examiner* — Tulsidas C Patel
*Assistant Examiner* — Harshad Patel
(74) *Attorney, Agent, or Firm* — Wei Te Chung; Andrew C. Cheng; Ming Chieh Chang

(57) ABSTRACT

An electrical connector includes an insulative housing having a mating face, a mounting face, a pair of side walls, a elongated central slot recessed downwardly from the mating face, a first end wall and a second end wall, the central slot being positioned between the side walls, the first end wall and the second end wall, the side walls include a plurality of passageways communicating with the central slot; a plurality of contacts being retained in the passageways respectively and protruding into the central slot; a metal board lock extending downwardly through the first end wall and being attached to the first end wall; a retainer attached to the first end wall to mating with a corresponding card; the board lock is sandwiched between the retainer and the first end wall.

10 Claims, 6 Drawing Sheets

ELECTRICAL CONNECTOR WITH AN IMPROVED BOARD LOCK

BACKGROUND OF THE INVENTION

1. Field of the Invention

The present invention generally relates to an electrical connector and more particularly to a card edge connector having an improved board lock.

2. Description of Related Art

A conventional PCI Express (Peripheral Component Interconnect Express, PCIe) connector is assembled on the mother board of a computer to receive PCIe add-in card. An insulative housing of the PCIe connector generally includes an elongated central slot between a pair of side walls, a number of passageways are formed on the side walls to communicate with the central slot. A plurality of electrical contacts are received in the passageways correspondingly, the contacts extend into the central slot to establish electrical connection with the PCIe add-in card. In order to secure the card in the central slot reliably, the card is provided with an cutout on one end thereof, correspondingly, the PCIe connector has a retainer to lock with the cutout. A pair of insulative column posts project downwardly from a bottom side of the housing to be inserted into holes on the mother board, however, the post is adjacent to the retainer, the movement of the retainer during locking with or disengaging with the PCIe card can impose an force on the posts, that is to say, the posts is easy to be vibrated. Therefore, the PCIe connector is not secured on the mother board desirably.

It is thus desired to provide an electrical connector having an improved post.

SUMMARY OF THE INVENTION

According one aspect of the present invention, an electrical connector includes an insulative housing having a mating face, a mounting face, a pair of side walls, a elongated central slot recessed downwardly from the mating face, a first end wall and a second end wall, the central slot being positioned between the side walls, the first end wall and the second end wall, the side walls include a plurality of passageways communicating with the central slot; a plurality of contacts being retained in the passageways respectively and protruding into the central slot; a metal board lock extending downwardly through the first end wall and being attached to the first end wall; a retainer attached to the first end wall to mating with a corresponding card; the board lock is sandwiched between the retainer and the first end wall.

According to another aspect of the present invention, an electrical connector includes an insulative housing having a mating face, a mounting face, a pair of side walls, a elongated central slot recessed downwardly from the mating face, a first end wall and a second end wall, the central slot being positioned between the side walls, the first end wall and the second end wall, the side walls include a plurality of passageways communicating with the central slot, the first end wall defining a cavity extending downwardly through either the mating face or the mounting face, the cavity extending outwardly through the first end wall along a lengthwise direction thereof; a plurality of contacts being retained in the passageways respectively and protruding into the central slot; a retainer secured to the cavity of the first end wall to mating with a corresponding card.

Other objects, advantages and novel features of the present invention will become more apparent from the following detailed description of the present embodiment when taken in conjunction with the accompanying drawings.

DETAILED DESCRIPTION OF THE INVENTION

Figure 1:
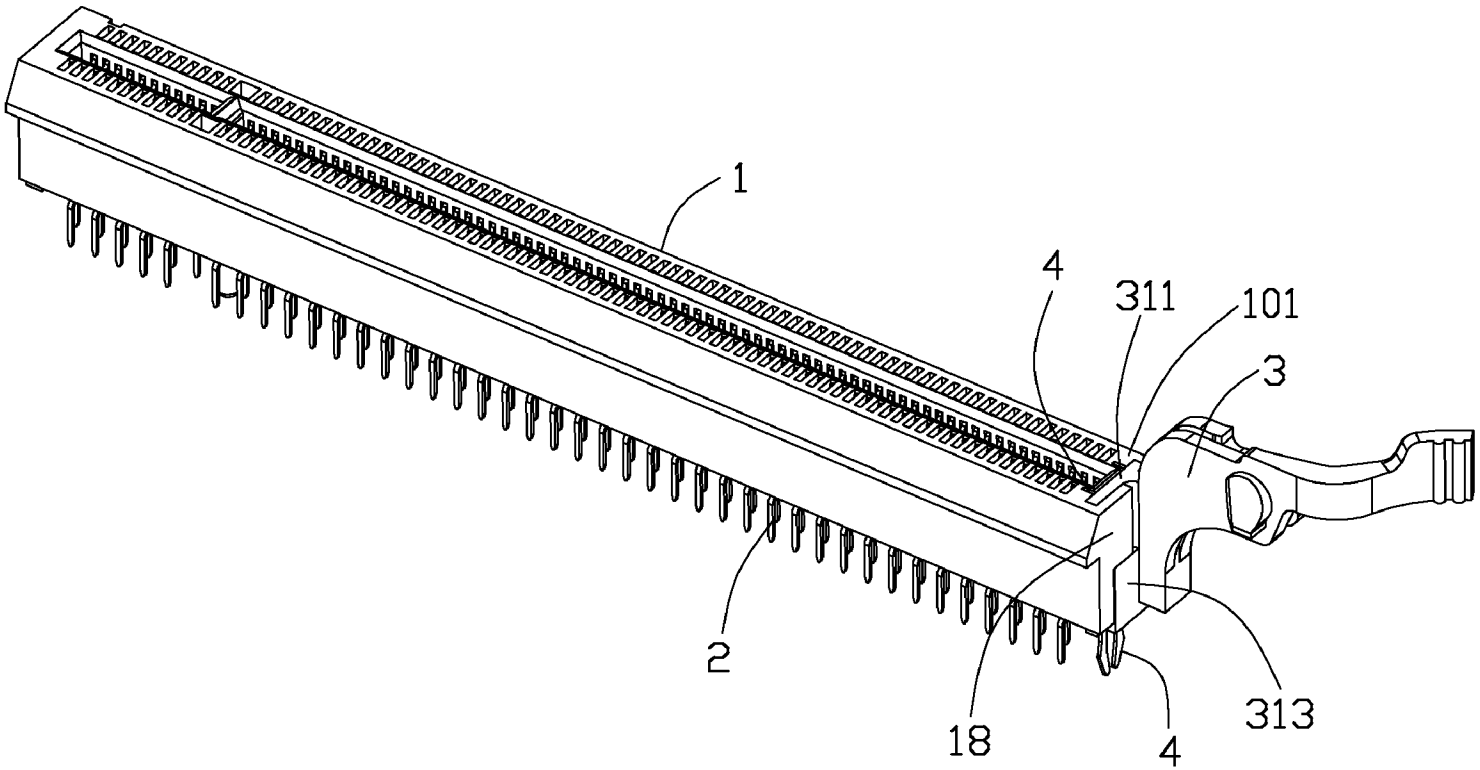
FIG. 1 is an assembled perspective view of an electrical connector according to the present invention.

Reference will now be made to the drawing figures to describe the preferred embodiment of the present invention in detail.

Figure 2:
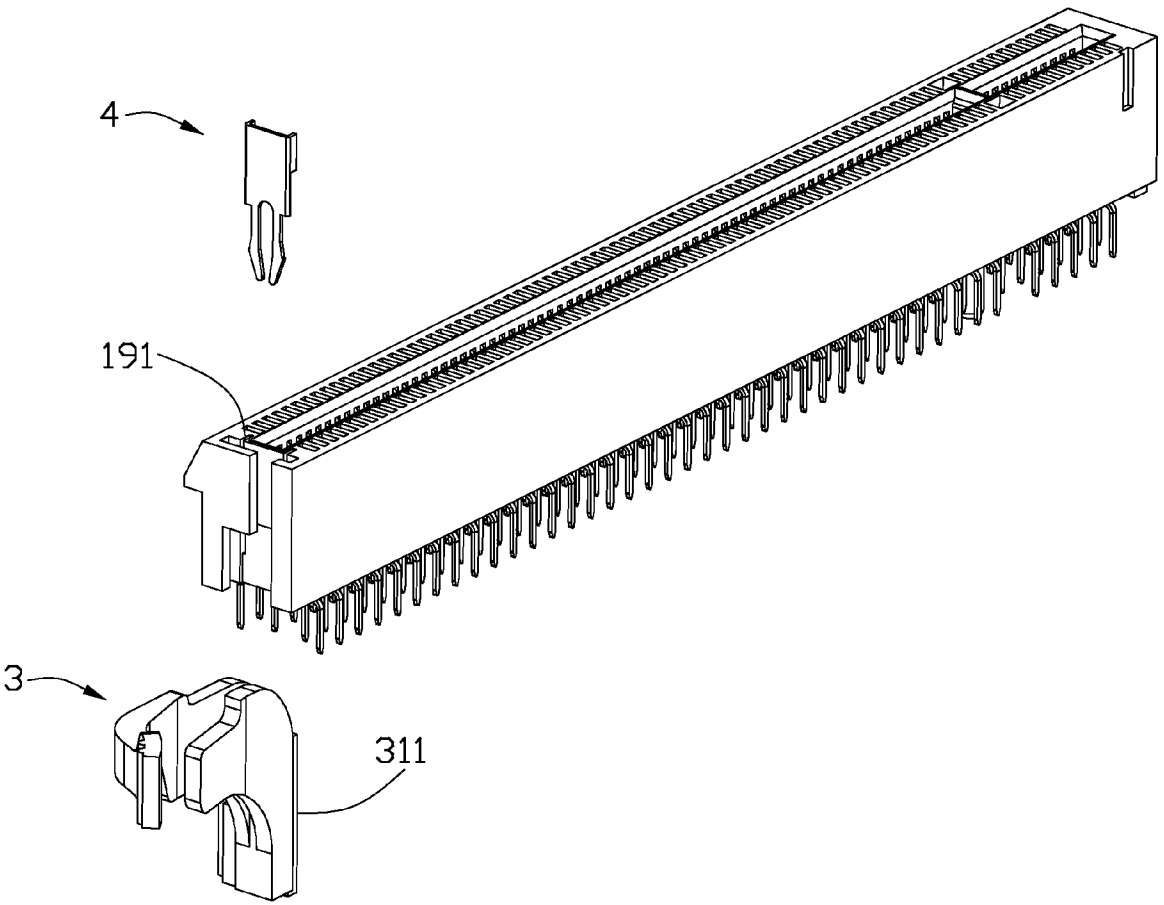
FIG. 2 is an partially exploded perspective view of the electrical connector shown in FIG. 1.
Figure 3:
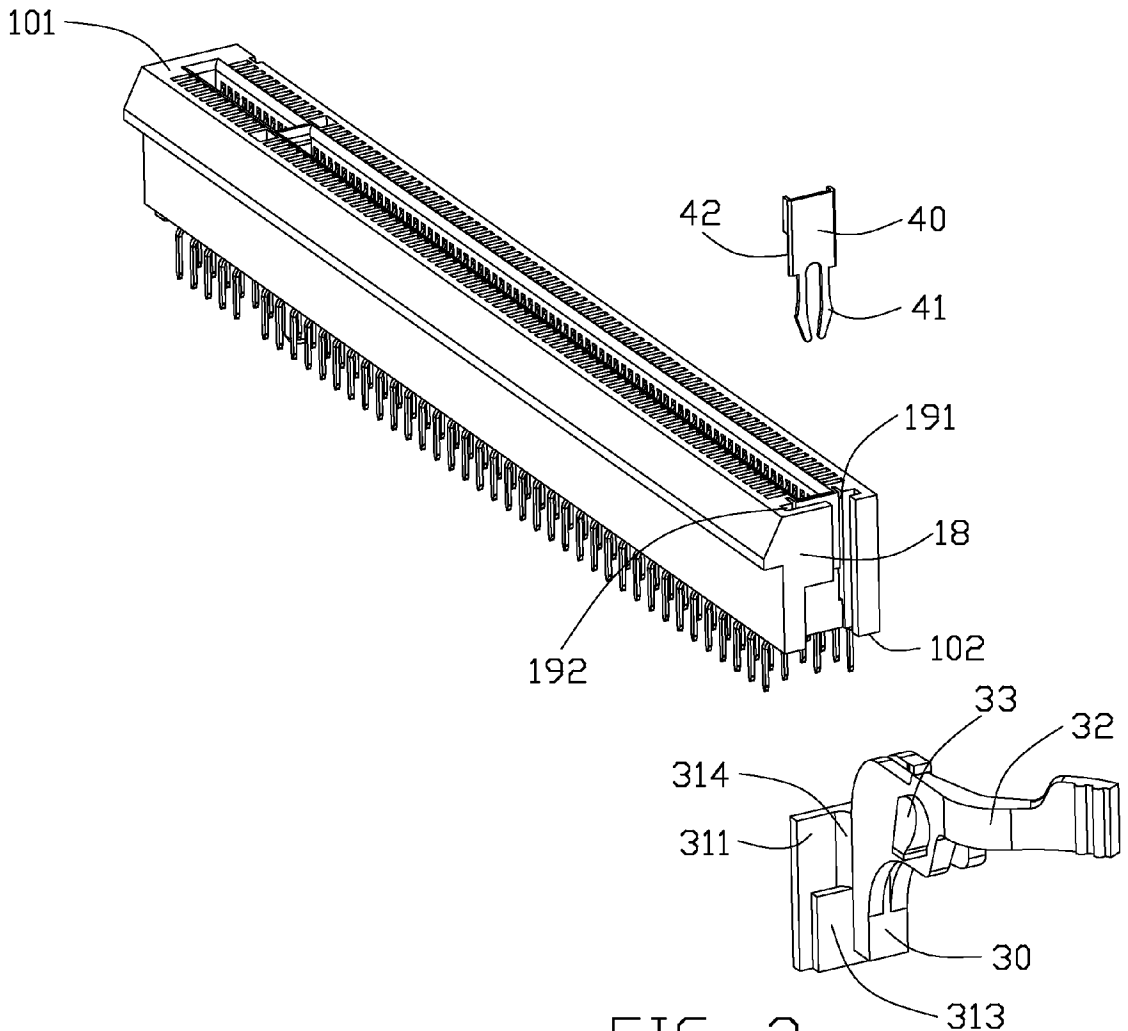
FIG. 3 is a view similar to FIG. 2, while taken from a different aspect.
Figure 4:
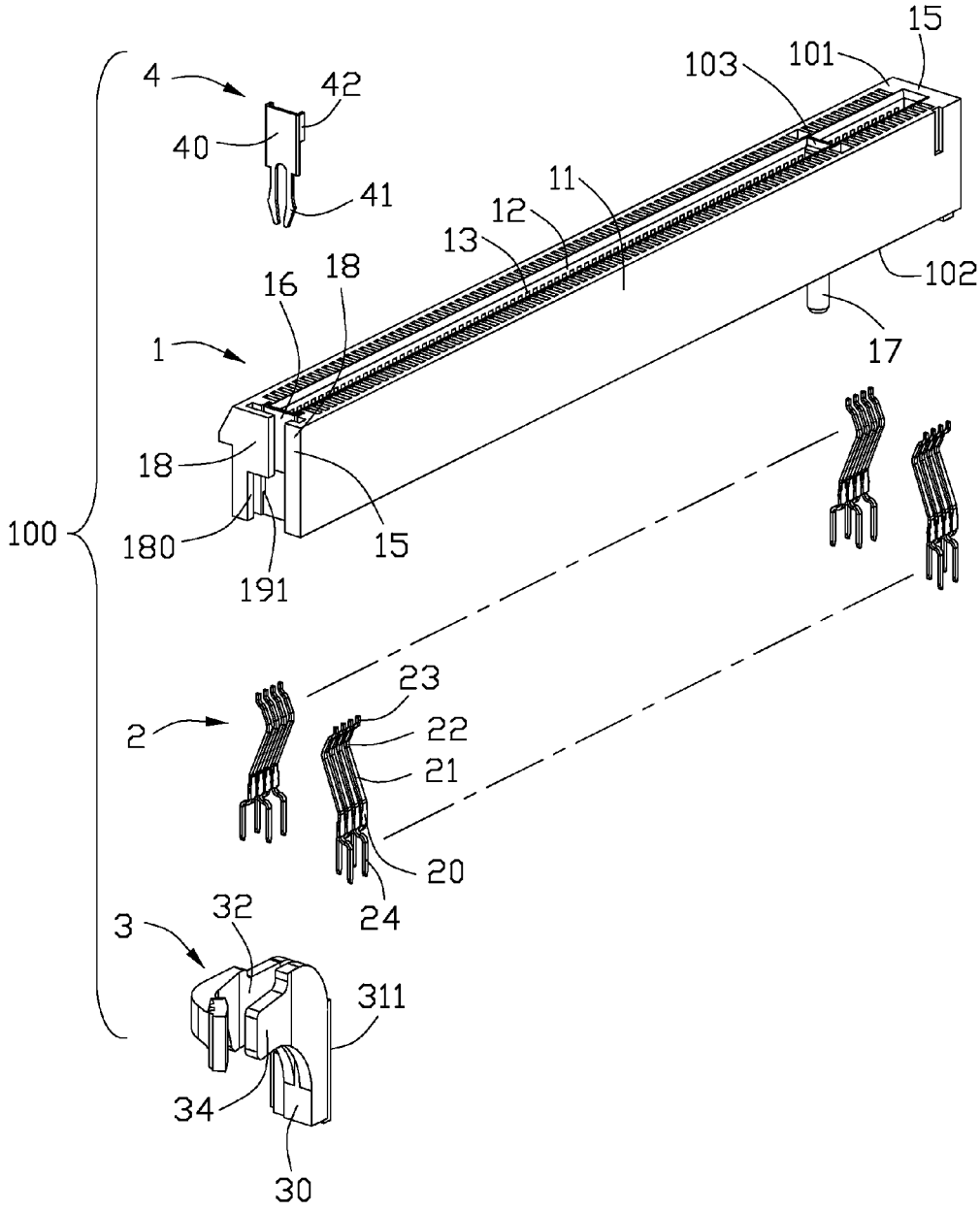
FIG. 4 is an exploded perspective view of the electrical connector shown in FIG. 1.
Figure 5:
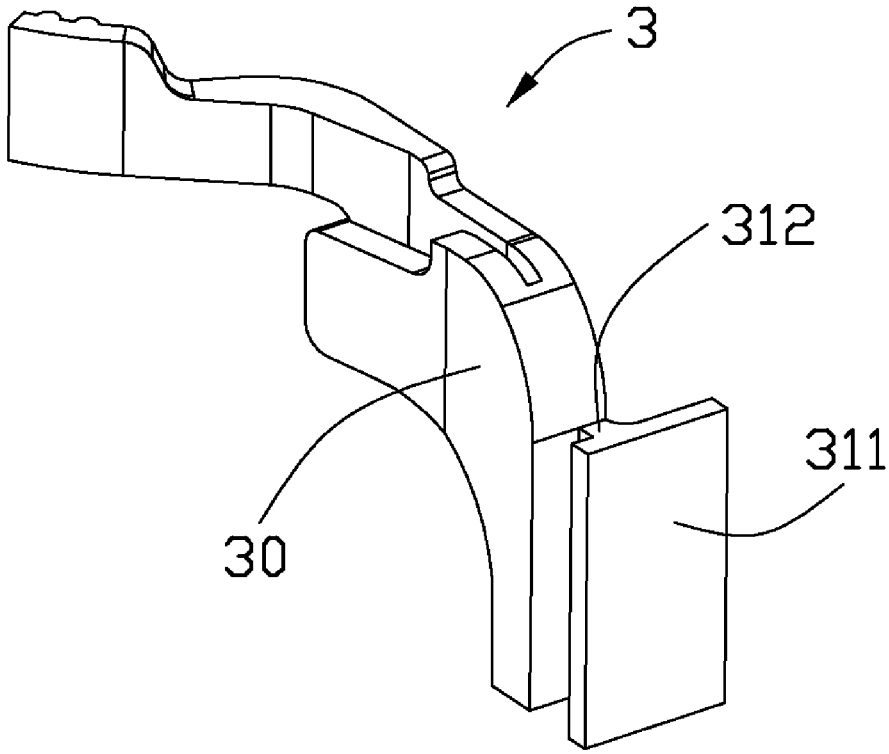
FIG. 5 is a perspective view of a retainer shown in FIG. 4.
Figure 6:
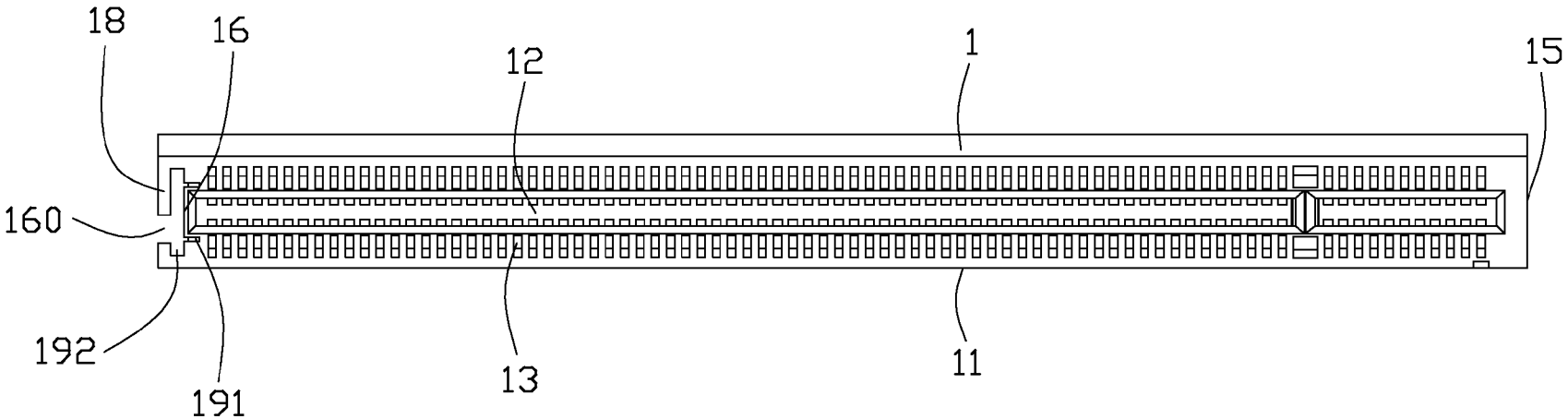
FIG. 6 is a top plan view of an insulative housing shown in FIG. 4.

Referring to FIGS. 1, 2 and 3, an electrical connector 100, preferably an PCIe connector, comprises an insulative housing 1, a plurality of electrical contacts 2 and a retainer 3 retained on the housing 1. The insulative housing 1 of the PCIe connector generally includes a mating face 101, a mounting face 102 opposite to the mating face 101, an elongated central slot 12 between a pair of side walls 11, a number of passageways 13 are formed on the side walls 11 to communicate with the central slot 12. A plurality of electrical contacts 2 are received in the passageways 13 correspondingly, the contacts 2 extend into the central slot 12 to establish electrical connection with a PCIe add-in card. The passageways 13 each protrudes upwardly through the mating face 101.

The contacts 2 each includes a vertical base portion 20, a soldering portion 24 extending downwardly from a bottom side of the second vertical base portion 20, a deflectable contacting arm 21 projecting upwardly from the vertical base portion 20. The deflectable contacting arms 21 define contacting portions 22 which are arranged in two rows along a lengthwise direction of the housing 1 to contact with opposite sides of the PCIe card. A tip end of the contacting arm 23 is configured to abut against the side wall 11 along a width direction of the housing 1 prior to insertion of the PCIe card into the central slot 12. The tip end of the contacting arm 23 is exposed to the exterior along a height direction of the housing 1.

The housing 1 includes a pair of end walls 15 positioned on outer sides of the passageway 13 along the lengthwise direction, the central slot 12 is formed between the side walls 11 and the end walls 15. A key portion 103 is located in the central slot 12 to connect the side walls 11 along the width direction. The key portion 103 is adapted to identify a mating PCIe card and ensure the mating PCIe card can be inserted downwardly into the central slot 12 with a lower edge of the PCIe card having an opening facing the key portion 103. The key portion 103 is closer to the right end wall 15 than the left end wall 15. An insulative post 17 projects downwardly from the mounting face 102 to be mounted on a mother printed circuit board.

The left end wall 15 is provided with a pair of slits 191 on a left side of the passageway 13, the slits 191 are located on opposite sides of the central slot 12 along the width direction. A retention groove 192 is formed on a left side of the slits 191 and communicates with the slits 191. The retention groove 192 is parallel to the passageways 13. A metal board lock 4 is attached to the left end wall 15 and defines a base portion 40, a pair of soldering legs 41 spaced from each other to be mounted on the mother printed circuit board. A pair of curved portions 42 extends inwardly along the lengthwise direction to be retained in the slits 191 correspondingly.

The retainer 3 includes a left vertical plate 311, a main portion 30, a connecting plate 312 connecting with the vertical plate 311 and the main portion 30. The connecting plate 312 is perpendicular to the vertical plate 311. The retainer 3 defines a flexible arm 32 and a restricting arm 34 spaced from each other along the width direction. A locking protrusion 33 projects inwardly from the flexible arm 32 to lock with the PCIe card. The flexible arm 32 is movable in a clockwise direction or a counterclockwise direction. During disengaging the lock protrusion 33 from the PCIe card, the flexible arm 32 is operated by an user to move along the counterclockwise direction, in this process, the restricting arm 34 is adapted to limit movement of the flexible arm 32 to avoid over-deformation of the flexible arm 32. When the manual operation is eliminated, the flexible arm 32 is able to move in the clockwise direction to the previous status.

The left end wall 15 defines an outer plate 18 on an outer side thereof and an inner plate 16 on an inner side thereof along the lengthwise direction. The outer plate 18 is provided with an opening 160 which extends along in both the height direction and the lengthwise direction thereof. The opening 160 includes an upper portion and a lower portion which has a width being larger than that of the upper portion. The connecting plate 312 comprises an upper plate 314 and a lower plate 313 which is perpendicular to the upper plate. The upper plate 314 is received in the upper portion of the opening 160, and the lower plate 313 is retained in a lower portion 180 of the opening 160. The lower plate 313 upwardly biases against a lower side of the outer plate 18. Both the width and the height of the lower plate 313 is smaller than that of the vertical plate 311. The vertical plate 311 is fixed in the retention grooves 192. The opening 160, retention grooves 192 and the slits 191 constitute a cavity of the left end wall 15. As shown in FIG. 3, the slits 191 are shorter than the opening 160, retention grooves 192. A lower edge of the curved portions 42 abuts downwardly against an inner and lower side wall of the slits 191, therefore, the curved portions 42 is prevented from falling downwardly from the left end wall 15.

The outer plate 18 and the lower plate 313 are located in a same vertical plane. The outer plate 18 abuts against the vertical plate 311 inwardly. Upper side faces of both the vertical plate 311 and the outer plate 18 are coplanar with the mating face 101. In assembly, the retainer 3 is attached to the left end wall 15 upwardly from a bottom side of the housing 1. The base portion 40 is sandwiched between vertical plate 311 and the inner plate 16 along the lengthwise direction of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mating face, a mounting face, a pair of side walls, an elongated central slot recessed downwardly from the mating face, a first end wall and a second end wall, the central slot being positioned between the side walls, the first end wall and the second end wall, the side walls including a plurality of passageways communicating with the central slot;

a plurality of contacts being retained in the passageways respectively and protruding into the central slot;

a metal board lock attached to the first end wall;

a retainer attached to the first end wall for locking with a corresponding card;

wherein the board lock is constantly sandwiched between the retainer and the first end wall, wherein the first end wall includes an outer plate on an outer side thereof and an inner plate on an inner side thereof along a lengthwise direction of the housing, wherein the first end wall defines a cavity to retain the retainer, the cavity includes a retention groove extending along a height direction of the housing and defined between the outer plate and the inner plate, the retainer comprises a vertical plate retained in the retention groove, wherein the board lock has a base portion which is also received in the retention groove to be sandwiched between the vertical plate and the inner plate along the lengthwise direction, wherein the cavity includes a pair of slits communicating with the retention groove, the slits are positioned on opposite sides of the central slot along a width direction of the housing, the board lock has a pair of curved portions extending inwardly along the lengthwise direction to be retained in the slits correspondingly.

2. The electrical connector as claimed in claim 1, wherein the vertical plate is retained between the outer plate and the base portion along the lengthwise direction.

3. The electrical connector as claimed in claim 1, wherein the slits are perpendicular to the retention groove, the retention groove is parallel to the passageways.

4. The electrical connector as claimed in claim 1, wherein the retainer includes a main portion, a connecting plate connecting with the vertical plate and the main portion, the outer plate is provided with an opening communicating with the retention groove, the connecting plate comprises an upper plate and a lower plate which is perpendicular to the upper plate, the upper plate is received in an upper portion of the opening, and the lower plate is retained in a lower portion of the opening.

5. The electrical connector as claimed in claim 4, wherein the outer plate and the lower plate are located in a same vertical plane.

6. The electrical connector as claimed in claim 4, wherein the board lock defines a top side face which is coplanar with an upper face of the vertical plate and the mating face.

7. The electrical connector as claimed in claim 4, wherein the width and the height of the lower plate is smaller than that of the vertical plate.

8. An electrical connector comprising:

an insulative housing having a mating face, a mounting face, a pair of side walls, an elongated central slot recessed downwardly from the mating face, a first end wall and a second end wall, the central slot being positioned between the side walls, the first end wall and the second end wall, the side walls including a plurality of passageways communicating with the central slot, the first end wall defining a cavity extending downwardly through the mating face or the mounting face, the cavity extending outwardly through the first end wall along a lengthwise direction thereof;

a plurality of contacts being retained in the passageways respectively and protruding into the central slot;

a board lock retained in the cavity and extending downwardly out of the housing; and a retainer secured to the cavity of the first end wall for locking with a corresponding card and abuting against the board lock in the lengthwise direction, wherein the cavity extends through the first end wall along a height direction of the housing, the first end wall includes an outer plate on an outer side thereof and an inner plate on an inner side thereof along the lengthwise direction of the housing, the cavity includes a retention groove defined between the outer plate and the inner plate, the retainer comprises a vertical plate to be retained in the retention groove, wherein the board lock has a base portion which is sandwiched between the vertical plate and the inner plate along the lengthwise direction, the vertical plate is retained between the outer plate and the base portion along the lengthwise direction, wherein the retainer includes a main portion, a connecting plate connecting with the vertical plate and the main portion, the outer plate is provided with an opening communicating with the retention groove, the connecting plate comprises an upper plate and a lower plate which is perpendicular to the upper plate, the upper plate is received in an upper portion of the opening, and the lower plate is retained in a lower portion of the opening.

9. The electrical connector as claimed in claim 8, wherein the cavity includes a pair of slits communicating with the retention groove, the slits are positioned on opposite sides of the central slot along a width direction of the housing, the board lock defines a pair of curved portions extending inwardly along the lengthwise direction to be retained in the slits correspondingly, the slits are perpendicular to the retention groove, the retention groove is parallel to the passageways.

10. The electrical connector as claimed in claim 8, wherein the outer plate and the lower plate are located in a same vertical plane, the board lock defines a top side face which is coplanar with the mating face and an upper face of the vertical plate.

* * * * *